US007237715B1

(12) United States Patent
Firestone

(10) Patent No.: US 7,237,715 B1
(45) Date of Patent: Jul. 3, 2007

(54) SYSTEM AND METHOD FOR COLLECTING VEHICLE ROAD-USE AND PARKING FEES AND FOR MONITORING VEHICULAR REGULATORY COMPLIANCE

(76) Inventor: Paul A Firestone, 88 Gentral Park West, New York City, NY (US) 10023

( * ) Notice: Subject to any disclaimer, the term of this patent is extended or adjusted under 35 U.S.C. 154(b) by 0 days.

(21) Appl. No.: 09/635,624

(22) Filed: Aug. 10, 2000

(51) Int. Cl.
*G07B 15/02* (2006.01)

(52) U.S. Cl. ..... 235/384; 705/13

(58) Field of Classification Search ..... 235/384, 235/375; 340/10.1–10.6; 705/13
See application file for complete search history.

(56) References Cited

U.S. PATENT DOCUMENTS 4,555,618 A * 11/1985 Riskin ..... 235/384
5,086,389 A * 2/1992 Hassett et al. ..... 705/13
5,424,727 A * 6/1995 Shieh ..... 340/928
5,459,304 A * 10/1995 Eisenmann ..... 235/380
5,485,520 A * 1/1996 Chaum et al. ..... 705/74
5,581,249 A * 12/1996 Yoshida ..... 340/928
5,587,575 A * 12/1996 Leitner et al. ..... 235/375
5,608,391 A * 3/1997 Bantli et al. ..... 340/933
5,663,548 A * 9/1997 Hayashi et al. ..... 235/384
5,734,343 A * 3/1998 Urbish et al. ..... 340/556
5,819,234 A * 10/1998 Slavin et al. ..... 235/375
6,052,068 A * 4/2000 Price R-W et al. ..... 340/933
6,252,524 B1 * 6/2001 Takikita ..... 340/933

FOREIGN PATENT DOCUMENTS

JP 08180227 A * 7/1996

* cited by examiner

*Primary Examiner*—Michael G. Lee
*Assistant Examiner*—Jamara A. Franklin
(74) *Attorney, Agent, or Firm*—Lucas & Mercanti, LLP

(57) ABSTRACT

The invention proposes a new and novel method to collect fees (or tolls) for road-usage and to make toll-booths unnecessary and obsolete. Monies thus collected by this invention can be used for maintenance and construction of all highways, bridges, tunnels, roads and city streets. The invention re-designs the method of toll-collection which insures a more equitable sharing by all owners of vehicles who use these roads under a variety of conditions.

1 Claim, 1 Drawing Sheet

SYSTEM AND METHOD FOR COLLECTING VEHICLE ROAD-USE AND PARKING FEES AND FOR MONITORING VEHICULAR REGULATORY COMPLIANCE

BACKGROUND OF THE INVENTION

Federal, state and local road transportation and highway departments have depended in large measure on the use of collected tolls for road maintenance and construction.

The efforts to collect road-use fees at bridges and tunnels in the form of tolls has resulted in traffic back-up at tollbooths with adverse effects to the environment, personal safety, and business enterprise. In municipalities, the parking meter has served as a passive toll taker, but this method of fee collecting has not been fully successful. Evidence of this is the recent, trial innovation of print-out time-parking receipts which are to be placed on a vehicle's dashboard.

Parking meters have proved to have labor intensive costs. Ill-prepared meter readers have often written inaccurate license numbers and street locations. Arguments in face-to-face confrontations between meter readers and motorists is common. Coin box theft and severe damage to meters caused by automobiles and vandals demands expensive repairs and maintenance.

Under the current methods employed by authorized toll collection agencies, a motor vehicle operator must subscribe to a transponder-type fee collection system or queue-up to pay the required fee in cash. Utilization of the "cash-only" process necessitates a toll collector who must complete the collection which involves a time-consuming event adding to delays and traffic congestion and untoward accidents. Transponder-type fee collections have been largely unsuccessful since a majority of motorists do not subscribe to this type of system.

In the matter of parking meters, the motorist has often been unduly punished and the municipality cheated of revenue. False coins put into meters and pilfering, and destruction of coin boxes are serious problems with the unguarded equipment.

Inclement weather may preclude the meter man's/maid's attention to the routine surveillance assigned to them in street parking areas, and often times, hard-pressed, in the hastily written summons, the meter reader may incorrectly cite an erroneous vehicle license number, and location, and the infraction concerning metered parking.

In large municipalities, the capital investment in equipment for towing and the cost for maintenance of a storage area for towed cars added to the needed salaried personnel may make the towing of cars a money-losing proposition. The traffic problems caused by double-parking in certain congested business areas of a municipality and the caravans of huge delivery trucks moving through the streets and parking on both curb-sides creates the difficulty of a single passage for traffic. The horde of leviathan trucks create the frenetic and hostile character of urban downtown business areas during daylight hours.

In municipalities, truck owners will receive fee-exemption credits if they utilize city streets during evening hours or can be afforded other incentives for time-sensitive vehicular activity.

Using proposed fixed and mobile scanning devices, this invention aims to construct a new and unique method for collecting road-use fees or tolls from all owners of registered vehicles regardless of the country or state that issued that vehicle's registration.

The invention relates to a method of collecting fees associated with vehicles for road usage wherein every vehicle contains its own unique identification code—similar or in concert with the known vehicle identification number (VIN)—comprised of a number, letter or symbol or combinations thereof.

Vehicle code readers (fixed or mobile) that transfer data to a central agency, or other appropriate means, are placed in selected area: entrances and exits to specified bridges, tunnels and highways. Municipalities will issue hand-held and auto-mounted vehicle-code-readers to police traffic managers who will in their normal course of activity scan designated streets to charge a fee for legal overnight parking, as well as for illegal double parking or standing, identifying the vehicle from its implanted I.D. code. The scanner is equipped to give full readings of date and time, and other relevant data as desired, to be programmed by the motor vehicle department, as well as the local police traffic manager. Traffic accidents can be immediately and easily recorded via the scanner and digital camera, verifying vehicle titles, insurance and the validity of licensed drivers. All these data can be instantly secured from stationery or mobile information capturing devices on moving or fixed I.D. codes.

Trucks and extended limousines can be assessed an additional road-use fee according to the number of axles and the approved laden weight, which incurs wear and tear of roads; and the limos will be assessed extended occupation of road and street space.

Most importantly, no current method provides for a passive, universal road-use system of collection of all vehicles.

The inventor is aware of the following U.S. patents which show efforts made to solve some of the problems described above: U.S. Pat. Nos. 6,097,292; 6,075,466; 6,010,074; 5,969,641; 5,955,970.

SUMMARY OF THE INVENTION

The invention proposes a new and novel method to collect fees for road use which fund costs for maintenance and construction of all highways, roads and city streets. It proposes a re-design of toll-collection that is to be more equitably shared by owners of all registered vehicles regardless of the place of registration issuance, in the United States, Canada and/or Mexico.

In addition, the current invention provides an instant method for monitoring vehicular regulatory compliance relating to insurance, emissions and exhaust, registration and title matters.

The instant invention relates to a cost-effective method of collecting vehicular related fees different from any current method, using a passive identification system similar to the UPC coding found in food and department stores, or the magnetic strip of a plastic credit card.

The office that issued vehicle registration will issue the vehicle's unique I.D. code and charge an appropriate amount to be held in an account against any and all road-usage charges and legal infractions associated with that vehicle's I.D. A periodic report containing identifications of time, place and fee charges can be sent to the title owner of the respective vehicle, and will note the account balance. If the title owner does not comply with the motor vehicle request, the standard delinquent response would follow.

All new vehicle manufacture will include the factory-installed I.D. codes in prescribed positions on the vehicle body.

According to the invention, each vehicle can be assigned a unique I.D. like a debit or credit card. The functioning of the scanner can be verified and/or modified at will by the appropriate personnel. It serves an important function beyond toll-taking. It will be programmed by the proper agencies to identify any vehicle that is unregistered, uninspected from emission control, operating without insurance, or in violation of any other conditions including the non-payment of charges or fees.

BRIEF DESCRIPTION OF THE DRAWINGS

The features of the present method which are believed to be novel are set forth by description within this application and may best be understood with reference to the accompanying drawings in which.

DETAILED DESCRIPTION OF THE INVENTION

Figure 2:
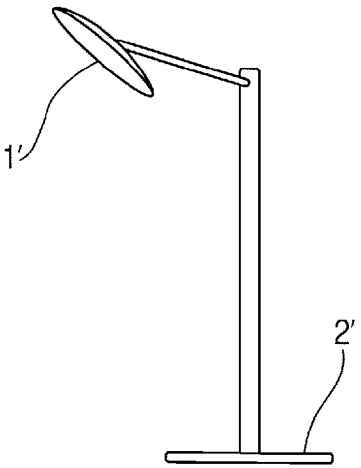
FIG. 2 is a model of a road-side, standing scanner to be aligned at desired locations to identify vehicle's utilization of bridges, tunnels, highways and city streets.
Figure 1:
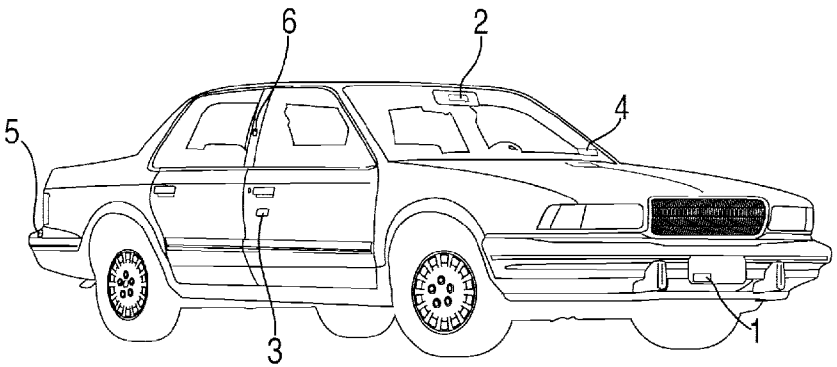
FIG. 1 is a vehicle with attached or implanted I.D. codes provided by the motor vehicle registration office. It is implanted or aligned in multiple locations of the vehicle, to be designated by the appropriate authorities.

A system and method for collecting vehicle fees wherein one or more unique I.D. code means, FIGS. 1, 1,2,3,4,5 and 6 are aligned so that the unique information can be easily captured and/or recorded by a scanning or other type of information collecting device, as in FIG. 2. The information capturing device 1', FIG. 2, is strategically placed. It may also be in a fixed or mobile position 2'.

Figure 3:
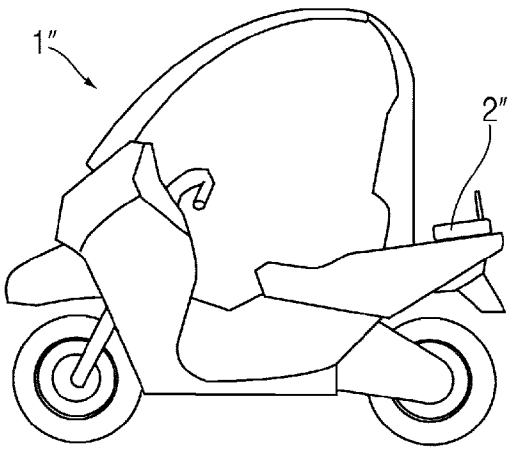
FIG. 3 is a suggested "manned" scooter that is easily maneuverable in traffic equipped with the I.D. scanners, digital cameras or other code information capturing devices.

FIG. 3 is a suggested use of the instant invention wherein a scooter 1" is fixed with I.D. code capturing equipment 2", wherein the captured data is disseminated by scooter equipment or communicated by known means to a central database for review.

I claim:

1. A method for collecting vehicle road-use and parking fees and for monitoring vehicular regulatory compliance, comprising the steps of:

(a) implanting a plurality of passive signaling devices on every vehicle registered in the United States, Canada and Mexico;

(b) issuing a mandatory unique vehicle identification code for each vehicle by a central motor vehicle registration agency, said code associated with the vehicle's vehicle identification number and with the registered owner of the vehicle;

(c) associating said code with said signaling devices;

(d) inputting information concerning said vehicle to said central agency, said information comprising vehicle title, insurance, driver license information, inspection and emissions;

(e) establishing an account at said central agency for the purpose of paying road-use and parking fees incurred by said vehicle during a period of time, said account not requiring a subscription;

(f) placing fixed vehicle code readers in selected areas near bridges, tunnels and highways;

(g) equipping traffic managers with mobile vehicle code readers;

(h) reading said identification code with said fixed or mobile vehicle code readers;

(i) communicating said identification code and a date and time to said central agency;

(j) using said code to charge said account with road-use and parking fees incurred by said vehicle during a period of time, which road-use fees include additional fees according to the number of vehicle axles and vehicle weight;

(k) using said code to monitor and verifying vehicular regulatory compliance relating to insurance, emissions, registration and title matters; and (l) issuing a periodic report to the title owner of the vehicle containing identifications of time, place, fee charges and account balance.

* * * * *

UNITED STATES PATENT AND TRADEMARK OFFICE

CERTIFICATE OF CORRECTION

PATENT NO. : 7,237,715 B1
APPLICATION NO. : 09/635624
DATED : July 3, 2007
INVENTOR(S) : Paul A Firestone It is certified that error appears in the above-identified patent and that said Letters Patent is hereby corrected as shown below:

Item (76) on the Title page, "88 Gentral Park" should read -- 88 Central Park --

Signed and Sealed this

Twenty-first Day of August, 2007

JON W. DUDAS
*Director of the United States Patent and Trademark Office*